US005878303A

United States Patent [19]

Endo

[11] Patent Number: 5,878,303

[45] Date of Patent: Mar. 2, 1999

[54] IMAGE FORMING DEVICE HAVING LAMINATING FUNCTION

[75] Inventor: Yoshinori Endo, Toyota, Japan

[73] Assignee: Brother Kogyo Kabushiki Kaisha, Nagoya, Japan

[21] Appl. No.: 876,533

[22] Filed: Jun. 16, 1997

[30] Foreign Application Priority Data

Jun. 27, 1996 [JP] Japan ..... 8-167552

[51] Int. Cl.[6] ..... G03G 21/00

[52] U.S. Cl. ..... 399/85; 399/407

[58] Field of Search ..... 399/85, 407, 411, 399/1; 430/97, 104

[56] References Cited

FOREIGN PATENT DOCUMENTS

A 7-295408 11/1995 Japan .

OTHER PUBLICATIONS

Patent Abstracts of Japan, Section P, No. 669, vol. 12, No. 58, p. 26, Feb. 20, 1988 and JP–A–62201471, Sep. 5, 1987. Patent Abstracts of Japan, Section P, Sect No. 631, vol. 11, No. 334, p. 128, Oct. 31, 1987 and JP–A–62116979, May 28, 1987. Patent Abstracts of Japan, Section P, Sect. No. 630, vol. 11, No. 331, p. 50, Oct. 29, 1987 and JP–A–62113182, May 25, 1987.

*Primary Examiner*—Richard Moses
*Attorney, Agent, or Firm*—Oliff & Berridge PLC

[57] ABSTRACT

A laser printer includes a photosensitive drum on which a toner image corresponding to an electrostatic latent image is formed, and a transfer roller in confronting relation to the photosensitive roller for transferring the toner image to a sheet passing between the drum and the transfer roller. The printer also includes a fixing portion at which the toner image on the sheet is fixed. A control unit is connected to the transfer roller for controlling a transfer bias to be applied thereto. A panel switch is provided to select one of a printing mode and a lamination mode. If lamination mode is selected, the fixing portion heat-seals a pair of lamination sheet members. In the lamination mode, no bias voltage is applied to the transfer roller when the lamination sheet members are passing between the photosensitive drum and the transfer roller for preventing residual toner on the drum and the roller from being transferred onto the lamination sheet members.

16 Claims, 8 Drawing Sheets

IMAGE FORMING DEVICE HAVING LAMINATING FUNCTION

BACKGROUND OF THE INVENTION

The present invention relates to an image forming device provided with a laminating function.

In a conventional image forming device such as a laser printer, there is provided a developing portion, a transfer portion, and a fixing portion. In the developing portion, an electrostatic latent image is formed on a photosensitive drum based on an imaging information, and a toner image corresponding to the electrostatic latent image is formed on the photosensitive drum. In the transfer portion, an image recording medium such as a sheet is interposed between the photosensitive drum and a transfer member imparted with a transfer bias voltage for transferring the toner image onto the sheet. In the fixing portion, the toner image transferred onto the sheet is fixed by heating the sheet. A sheet feed passage is provided passing successively through the transfer portion and the fixing portion.

In an electrophotographic type image forming device such as the laser printer and a facsimile machine those performing high speed printing, printing data such as text data and graphic data are transmitted from an external device such as a host computer or a personal computer. In the image forming device, the inputted printing data are developed into bit image data, and the developed bit image data are stored in a printing image buffer. In the developing portion, a line-base electrostatic latent image is successively formed on the photosensitive drum at every one dot line corresponding to one raster retrieved from the printing image buffer.

In a recent demand, a sheet protection such as a lamination becomes popular in such a manner that a rectangular sheet such as a card or a drive license card printed with an image is sandwiched and hermetically sealed by a pair of transparent lamination sheet members whose size is slightly greater than the rectangular card. For the lamination process, a lamination device is used where the pair of lamination sheet members are pressed at relatively high temperature.

As described above, the laser printer provides the fixing portion where the sheet is nipped between a heat roller and a pressure roller so as to pressedly melt the toner which has been transferred onto the sheet. To this effect, the fixing portion is adapted to generate a heating temperature of about 150° C. Thus, the fixing portion of the laser printer is available for the lamination process in terms of heating and pressing the lamination sheet members.

In this regards, there has been proposed an image forming device capable of performing a lamination process by allowing the lamination sheet members to pass through the sheet feed passage if the image forming process is not conducted.

With this arrangement, pressing force and heat provided by the fixing portion can be effectively utilized.

However, if the pair of lamination sheet members are merely fed past the sheet feed passage, residual toners on the photosensitive drum may be adhered onto the lamination sheet members even if the developing operation is not performed. As a result, surfaces of the lamination sheet members may be darkened by the toners. In other words, the surface of the lamination sheet members is contaminated with the toner. Then if the contaminated lamination sheet members is subjected to heat lamination, the toner is fixed on the lamination sheet members to provide a fog which is a dark, hazy deposit or veil of uniform density over all or parts of a surface of the lamination sheet members. Such disadvantage may be accelerated if the developing portion is operated for a prolonged period.

SUMMARY OF THE INVENTION

It is therefore an object of the present invention to provide an image forming device having laminating function in which the lamination sheet members are not contaminated with toners in case of a lamination mode.

This and other objects of the present invention will be attained by an image forming device for forming an image on an image recording medium and for heat sealing lamination sheet members, the device including a developing portion, a fixing portion, a passage, a mode setting unit and a control unit. The developing portion includes a photosensitive member and a transfer portion. An electrostatic latent image is formed on the photosensitive member in accordance with an imaging information for forming a toner image corresponding to the electrostatic latent image. The transfer portion is in confronting relation with the photosensitive member for transferring the toner image onto the image recording medium. The fixing portion is adapted for heating and fixing the toner image to the image recording medium. The passage passes between the photosensitive member and the transfer portion and passes through the fixing portion. One of the image recording medium and the lamination sheet members is selectively passed through the passage. The mode setting unit is adapted for setting one of a printing mode and a lamination mode. The fixing portion heat-seals the lamination sheet members when the lamination sheet members pass therethrough in the lamination mode. The control unit is connected to the mode setting unit and activates the transfer portion in response to a selection of the printing mode and deactivates the transfer portion in response to a selection of the lamination mode.

In another aspect of the invention, there is provided an image forming device for forming an image on an image recording medium and for heat sealing lamination sheet members, the device including a developing portion, a fixing portion, a passage, a mode setting unit, a voltage board, and a control unit. The developing portion includes a photosensitive drum and a transfer roller. An electrostatic latent image is formed on the photosensitive drum in accordance with an imaging information for forming a toner image corresponding to the electrostatic latent image. The transfer roller is in confronting relation with the photosensitive member for transferring the toner image onto the image recording medium. The fixing portion is adapted for heating and fixing the toner image to the image recording medium. The passage passes between the photosensitive drum and the transfer roller and also passes through the fixing portion. One of the image recording medium and the lamination sheet members is selectively passed through the passage. The mode setting unit is adapted for setting one of a printing mode and a lamination mode. The fixing portion heat-seals the lamination sheet members when the lamination sheet members pass therethrough in the lamination mode. The voltage board is connected to the transfer roller for applying a transfer bias voltage to the transfer roller. The control unit is connected between the mode setting unit and the voltage board for applying the transfer bias to the transfer roller in response to a selection of the printing mode and for preventing application of the transfer bias to the transfer roller in response to a selection of the lamination mode.

BRIEF DESCRIPTION OF THE DRAWINGS

In the drawings:

FIG. 8(*b*) is a cross-sectional view showing the lamination sheet members and the paper card.

DETAILED DESCRIPTION OF THE PREFERRED EMBODIMENTS

Figure 1:
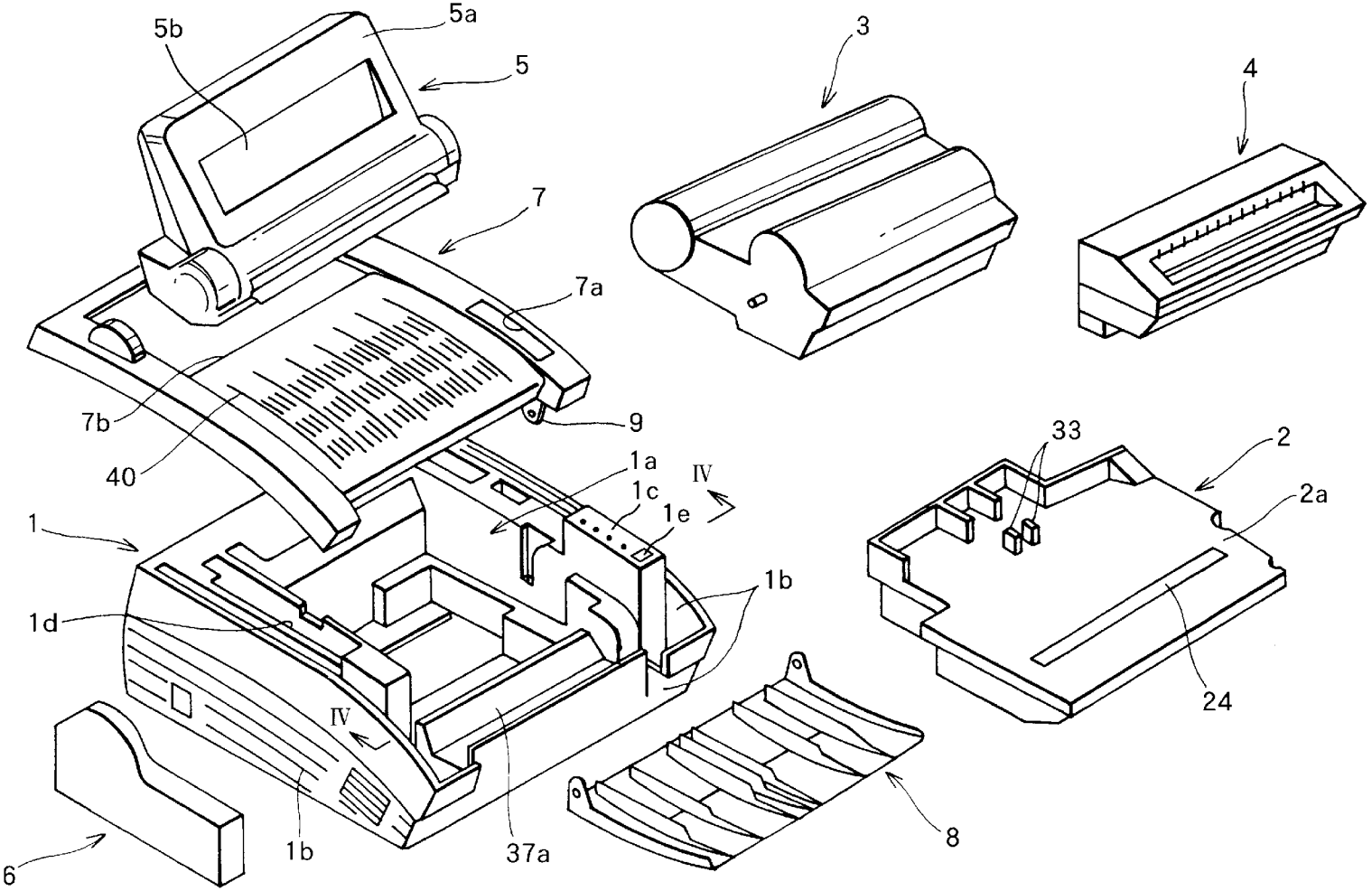
FIG. 1 is an exploded perspective view showing various parts and units of a laser printer according to one embodiment of the present invention.

An image forming device according to one embodiment of the present invention will be described with reference to the accompanying drawings. The illustrated embodiment pertains to a laser printer, which includes a main body 1 made of synthetic resin and having a main frame 1*a* and a main cover 1*b* as shown in FIG. 1. The main frame 1*a* has a box shape and has an upper open end. The main frame 1*a* accommodates therein a scanner unit 2 as an exposure unit, a process unit 3 serving as an image transfer portion, a fixing unit 4 and a sheet feed unit 5. These units can be installed in the main frame 1*a* from its upper opening. The main cover 1*b* serves to cover the four sides (front and rear sides and right and left sides) of the main frame 1*a*. The main frame 1*a* and the main cover 1*b* are integrally formed with injection molding or the like.

A drive system unit 6 including a drive motor and a gear train is disposed into an accommodation recess 1*d* defined in FIG. 1 between the left side inner surface of the main cover 1*b* and the left side of the main frame 1*a* adjacent thereto. The drive system unit 6 is inserted into the accommodation recess 1*d* through its lower opening.

A top cover 7 made of synthetic resin is in the form of a body cover for covering the upper open end of the main frame 1*a* and the main cover 1*b*. The top cover 7 is formed with an opening 7*a* which allows an operation panel 1*c* to extend therethrough. The operation panel 1*c* serving as mode setting means protrudes upwardly from the right side of the main frame 1*a*. The operation panel 1*c* has a panel switch 1*e*. The top cover 7 is also formed with an opening 7*b* through which a base end of the sheet feed unit 5 extends. A plurality of air outlets 40 are formed in the top cover 7 so as to allow cooling air to discharge therethrough. Further, a base end of a discharge tray 8 is mounted pivotally up and down to a couple of brackets 9 (one of which is visible) projectingly provided on opposite ends at the front edge of the top cover 7. The arrangement is such that when the discharge tray 8 is not used, the discharge tray 8 is collapsible toward and seated on the upper surface side of the top cover 7.

The sheet feed unit 5 includes a feeder case 5*a* in 15 which sheets P are accommodated in a stacked manner. A sheet supply roller 11 is rotatably disposed in the sheet feed unit 5, and a support plate 10 is urgedly disposed toward the sheet feed roller 11 by a biasing spring 10*a* disposed within the feeder case 5*a*. The sheet feed roller 11 is drivingly rotated by the drive system unit 6. Further, a separation pad 12 is disposed in confronting relation with the sheet feed roller 11. Thus, leading edges of sheets of paper P are pressed toward the sheet feed roller 11 by the support plate 10, and are separated one by one by the separation pad 12 and the sheet feed roller 11.

The thus separated sheet of paper P is delivered to the process unit 3 by means of a pair of upper and lower resist rollers 13, 14 for forming a toner image on the surface of the sheet of paper P in the process unit 3. The image is fixed by a heat roller 15 and a pressure roller 16 of the fixing unit 4, and then the sheet of paper P carrying the fixed image is discharged onto the discharge tray 8 by way of a sheet discharge unit including a discharge roller 17 and a pinch roller 18 which are located downstream of the heat roller 15 and the pressure roller 15 within a fixing unit case.

A manual insertion port 5*b* which is open in an upwardly slanting manner is provided at the sheet feed unit 5. A sheet different from the sheet P of the sheet stack or a lamination sheet member can be inserted into the sheet feed passage through the manual insertion port 5*b*. A path between the manual insertion port 5*b* and the sheet supply roller 11 serves as a manual sheet feed passage.

The process unit 3 is located in substantially the middle, when viewed in plan view, of the main frame 1*a*. At a position below the process unit 3, an upper support plate 2*a* of the scanner unit 2 is secured by means of screws (not shown) to a stay section (not shown) integrally projecting upwardly from a bottom plate of the main frame 1*a*. The upper support plate 2*a* is made of a synthetic resin, and essential components of the scanner unit 2 are disposed below the upper support plate 2*a*.

The scanner unit 2 serving as the exposure unit includes a laser emitting section, a polygon mirror 20, a lens 21, a reflection mirror 22, etc. The upper support plate 2*a* is formed with a transversely elongated scanner aperture. The aperture extends in a direction parallel with an axial direction of a photosensitive drum 23 of the process unit 3. Further, a glass plate 24 is provided for covering the aperture. A laser beam irradiated from the laser emitting section passes through the glass plate 24 and the aperture and reaches the peripheral surface of the photosensitive drum 23 of the process unit 3 for exposing the photosensitive drum 23 to the laser beam.

Figure 2:
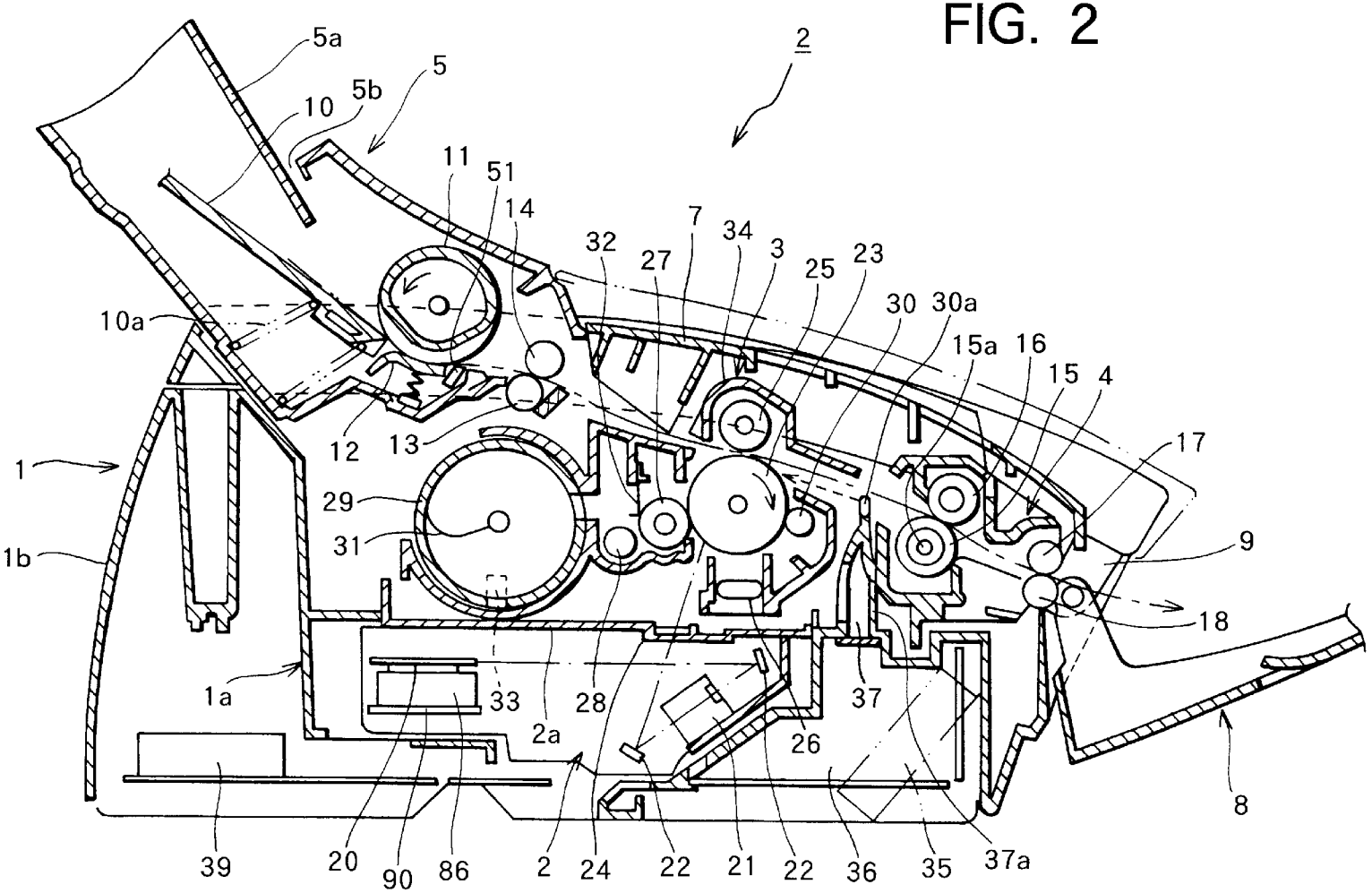
FIG. 2 is a schematic cross-sectional view showing the laser printer of FIG. 1.

As shown in FIG. 2, the process unit 3 includes the photosensitive drum 23, a transfer roller 25 positioned thereabove and in nipping relation therewith, a scorotoron charger 26 positioned below the photosensitive drum 23, a developing unit disposed upstream of the photosensitive drum 23 in the sheet feed direction and having a developing roller 27 an a toner supply roller 28, a toner cartridge 29 disposed on the upstream side of the developing unit and serving as a development agent (toner) supply section, and a cleansing roller 30 disposed downstream of the photosensitive drum 23. An agitating element 31 is rotatably provided in the toner cartridge for agitating the toner. Further, a blade 32 is provided in contact with a peripheral surface of the developing roller 27. The entire process unit 3 is incorporated into a case 34 made of a synthetic resin to make a cartridge. The process unit 3 in the form of a cartridge is removably attached to the main frame 1*a*.

An electrostatic latent image is formed on the outer periphery of the photosensitive drum 23 by scanning with the scanner unit 2 while charging the peripheral surface of the photosensitive drum 23 by the charger 26. The developing agent or the toner accommodated in the toner cartridge 29 is stirred by the agitating element 31 and discharged from the toner cartridge 29. The toner is then carried on the outer periphery of the developing roller 27 by means of the toner supply roller 28. The thickness of the toner layer formed on the developing roller 27 is regulated by the blade 32. The electrostatic latent image on the photosensitive drum 23 becomes visible by the adhesion of the toner supplied from the developing roller 27. The visible toner image is then transferred onto the sheet of paper P passing through the nip between the transfer roller 25 and the photosensitive drum 23, the transfer roller 25 being applied with a transfer bias voltage opposite the voltage applied to the photosensitive drum 23. Then, the toner remaining on the photosensitive toner 23 is temporarily collected by the cleaning roller 30 and then returned onto the photosensitive drum 23 at a predetermined timing. Then the toner on the photosensitive drum 23 is collected into the interior of the process unit 3 by means of the developing roller 27.

The upper support plate 2*a* of the scanner unit 2 is provided with an upwardly protruding toner sensor 33 consisting of a light emitting portion and a light receiving portion. Further, the toner cartridge 29 has a bottom portion formed with a recess. The toner sensor 33 is positioned within the recess for detecting the presence or absence of the toner within the toner cartridge 29.

On the bottom surface side of the junction between the front portion of the main frame 1*a* and the front portion of the main cover 1*b*, there are provided an accommodation section 36 for accommodating a cooling fan 35 and a ventilation duct 37 transversely extending in the direction orthogonal to the passing direction of the sheet of paper P. The accommodation section 36 and the ventilation duct 37 are fluidly connected to each other. The ventilation duct 37 is defined by an upper plate portion 37*a* having a V-shape in section and is formed with a plurality of slits. The upper surface portion 37*a* is positioned between the process unit 3 and the fixing unit 4 so as to prevent heat generated from the heat roller 15 in the fixing unit 4 from being directly transmitted to the process unit 3.

A cooling air generated by the cooling fan 35 passes through the interior of the ventilation duct 37 and then passes along a bottom surface of the main frame 1*a* to cool a power supply source 39 (see FIG. 2) and a drive motor (not shown) of the drive system unit 6. The power supply source 39 is positioned at the rear part of the main frame 1. Simultaneously, the cooling air ejects through the plurality of slits toward the process unit 3, and then upwardly moves through a gap between the process unit 3 and the fixing unit 4. The cooling air is then discharged through the plurality of air outlets 40 formed in the top cover 7.

Figure 8:
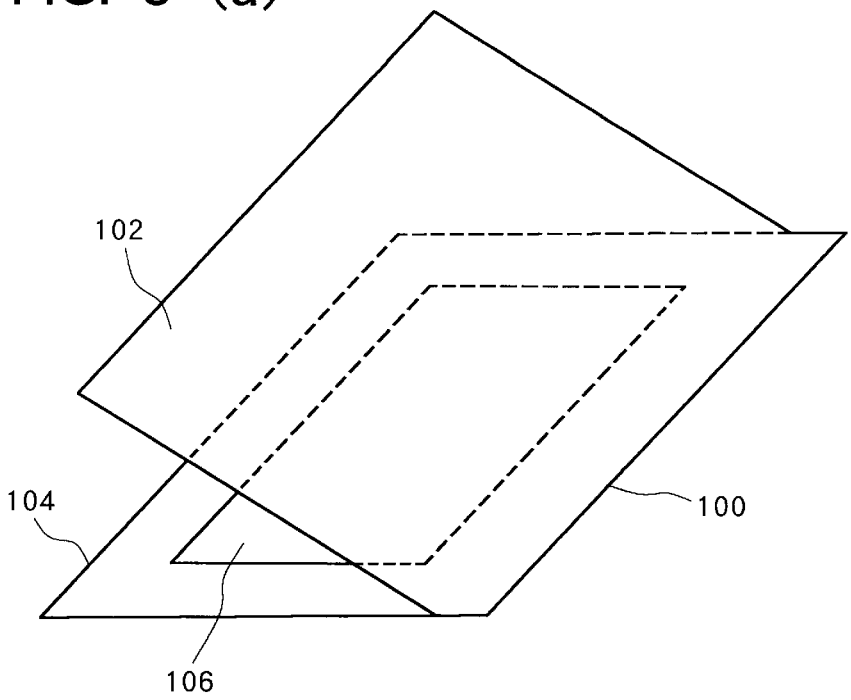
FIG. 8(*a*) is a perspective view showing lamination sheet members and a paper card to be laminated thereby.
Figure 8:
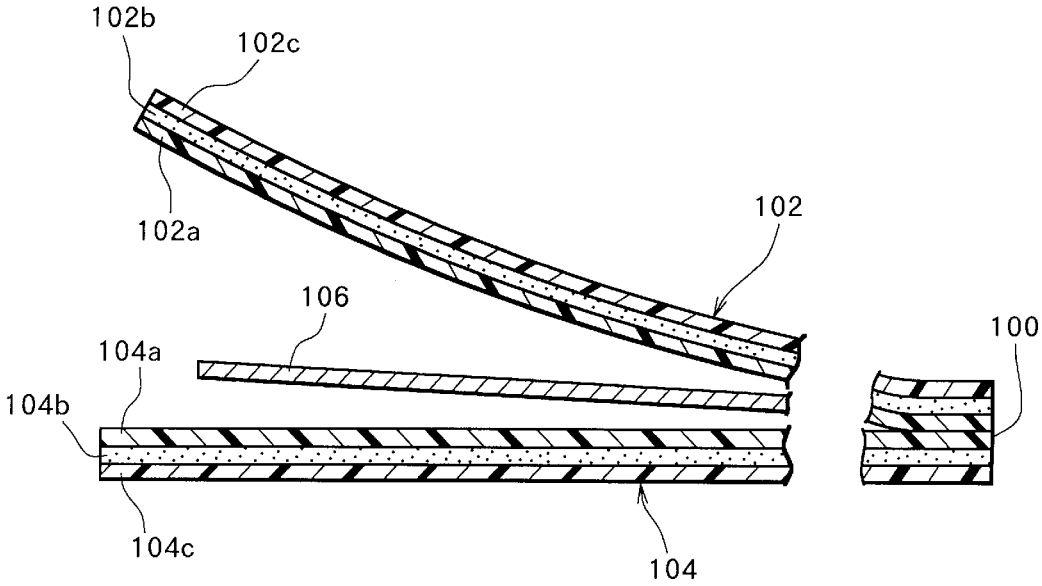

As shown in FIGS. 8(*a*) and 8(*b*), the lamination sheet members 102,104 includes inner polyethylene layers 102*a*, 104*a* confrontable with each other, an outer polyethylene terephthalate layers 102*c*, 104*c* and intermediate layers 102*b*, 104*b* made of EEA (ethylene ethyl acrylate copolymer). With this arrangement, when the two lamination sheet members 102, 104 are pressurizingly heated by the heat roller 15 and the pressure roller 16, the inner polyethylene layers 102*a*, 104*a* are melted at a temperature of about 80° C. In accordance with the melt of the inner polyethylene layers 102*a*, 104*a*, the intermediate EEA layers 102*b*, 102*b* are exposed, so that the lamination sheet members 102, 104 are bonded together interposing the sheet card therebetween. Incidetally, the configuration of the lamination sheet members 102, 104 can be maintained because the external polyethylene terephthalate layers 102*c*, 104*c* have melting point greater than 150° C.

A sheet supply sensor 51 (FIG. 3) is disposed between the sheet supply roller 11 and the resist roller 13 for detecting the sheet P when the sheet P is moved past the sensor 51.

Figure 3:
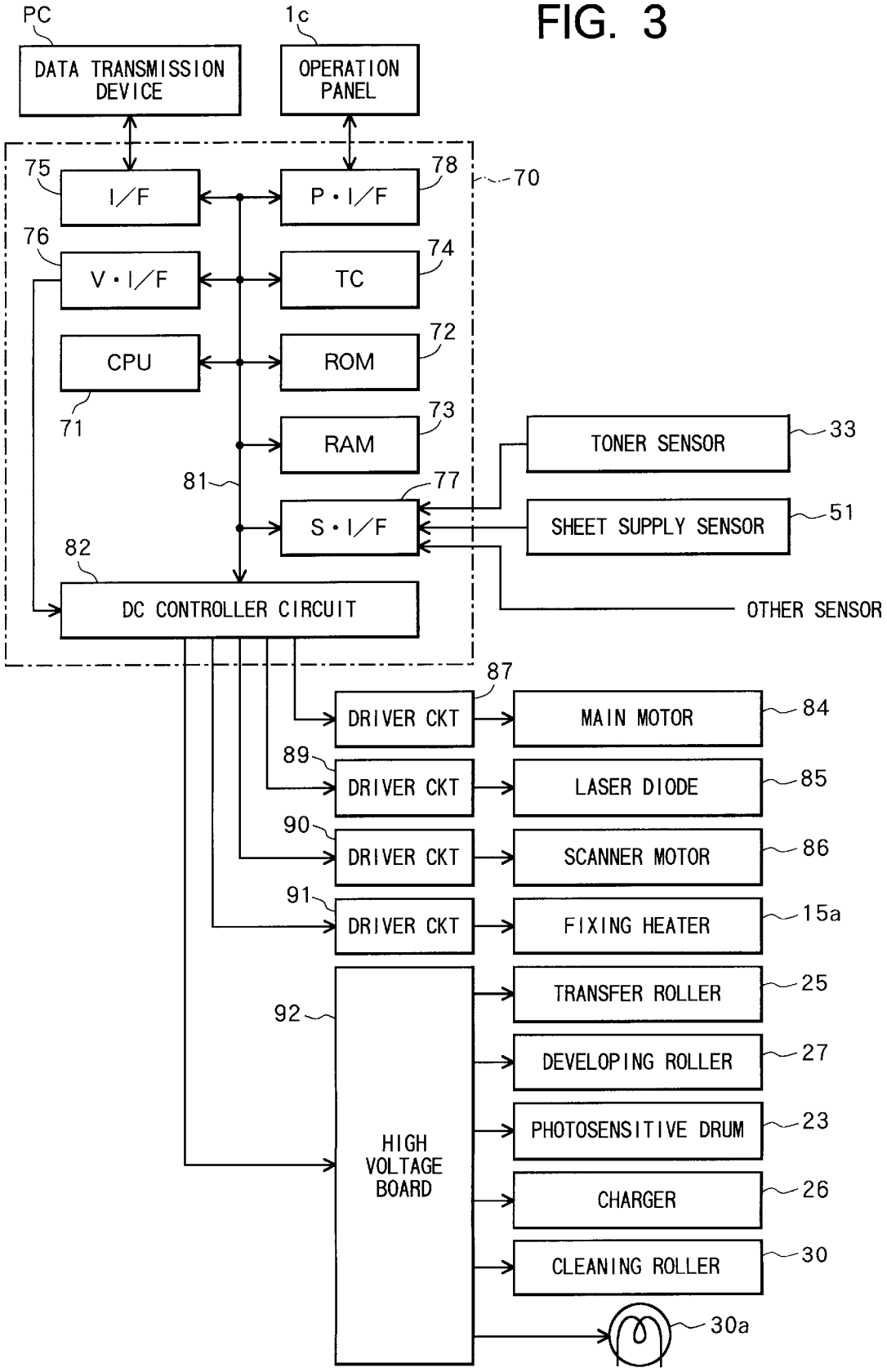
FIG. 3 is a block diagram showing a control unit and various components connected thereto according to the embodiment of this invention.

A control unit 70 is provided at a right side space defined between the main frame 1*a* and the main cover 1*b*. As best shown in FIG. 3, various components and circuits are connected to the control unit 70. The control unit 70 includes a CPU 71, a ROM 72, a RAM 73, a timing control circuit (TC) 74, an interface (I/F) 75, a video interface (V·I/F) 76, a sensor interface (S·I/F) 77, and a panel interface (P·I/F) 78 those connected to the CPU 71 by a bus 81. The ROM 72 stores therein various control programs. The RAM 73 is provided with various memories such as a data receiving buffer which stores therein data transmitted from an external data transmission device PC such as a personal computer and a host computer. The timing control circuit (TC) 74 is adapted for generating a timing signal which determines a timing for writing and reading the inputted data. The interface (I/F) 75 is adapted for receiving the transmitted printing data. The video interface (V·I/F) 76 is provided with a scan buffer and is adapted for sequentially transmitting printing information converted as bit image data to a DC controller circuit 82. The sensor interface (S I/F) 77 is adapted for receiving detection signals transmitted from the toner sensor 33, the sheet sensor 51 and other sensors such as a sheet discharge sensor (not shown) disposed adjacent the pinch roller 18. The panel interface (P I/F) 78 is adapted for receiving a switching signal transmitted from an operation panel 1*c* as a result of mode selection between an image forming mode and a lamination mode.

The following are connected to the DC controller circuit 82, a driver circuit 87 for the main motor 84, a driver circuit 89 for the laser diode 85, a driver circuit 90 for a scanner motor 86, a driver circuit 91 for the heater 15*a* in the heat roller 15, and a high voltage board 92. The main motor 84 is adapted for driving a sheet supply side feeding mechanism such as the sheet supply roller 11, the resist roller 13, 14 and the photosensitive drum 23, and for driving the heat roller 15, the pressure roller 16 and a sheet discharge side feeding mechanism such as the discharge roller 17 and the pinch roller 18. The scanner motor 86 is adapted for driving the polygon mirror 20. The high voltage board 92 is adapted for generating high voltage in the photosensitive drum 23, the transfer roller 25, the charger 26, the developing roller 27 and the cleaning roller 30 and for lighting the discharge lamp 30*a*.

The ROM 72 stores therein various control program for image forming operation in the laser printer in case of the image forming mode (printing mode), control program for fuse-bonding the lamination member to produce a laminate sheet in the lamination mode, and a memory managing program for managing capacity and leading address of the data receiving buffer and a printing image memory, the data receiving buffer being provided in the RAM 73. The ROM 72 is also provided with a font memory storing therein printing dot pattern data with respect to various characters and marks.

Figure 4:
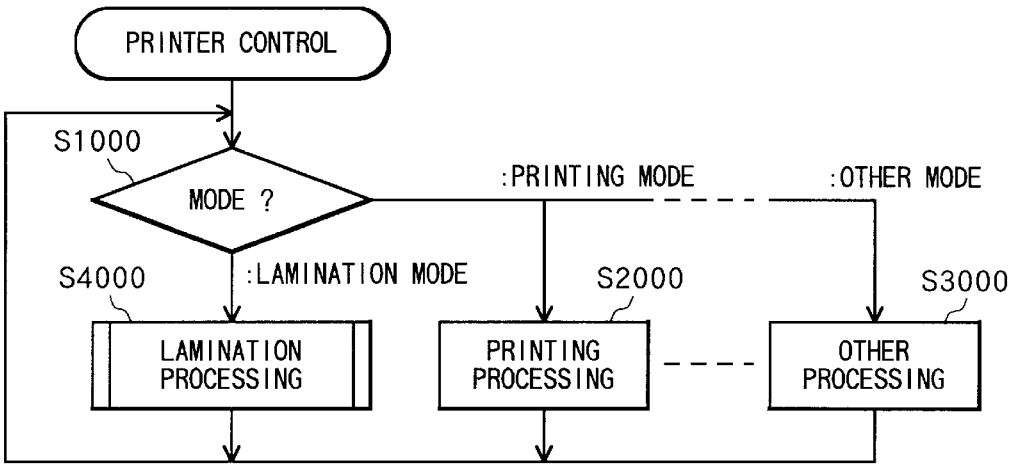
FIG. 4 is a flowchart showing a printer control executed in the control unit.

Next, a printer control routine executed by the control unit 70 will be described with reference to flowcharts shown in FIGS. 4 and 5. Upon start of the printer control routine as a result of turning ON an electrical power supply, setting mode in the operation panel 1*c* is judged (S1000). The mode setting is made by operating the panel switch 1*e* of the operation panel 1*c*.

If the printing mode which is a default mode has been set, printing processing will be executed (S2000) upon receipt of the printing data from the external data transmission device PC.

In the printing process, a sheet P of the sheet stack accommodated in the feeder case 5*a* of the sheet feed unit 5 is separated from the remaining sheet stack by the rotating sheet supply roller 11 driven by the driving unit 6 and the separation pad 12, and the thus separated sheet is fed to the pair of upper and lower resist rollers 13, 14. The resist rollers 13, 14 feed the sheet P to the process unit 3 where the toner image is formed on the surface of the sheet P. The sheet carrying the toner image is fed to the heat roller 15 and the pressure roller 16 of the fixing unit 4 where the toner image is fixed. The sheet P is then discharged onto the discharge tray 8 by the discharge roller 17 and the pinch roller 18.

Figure 6:
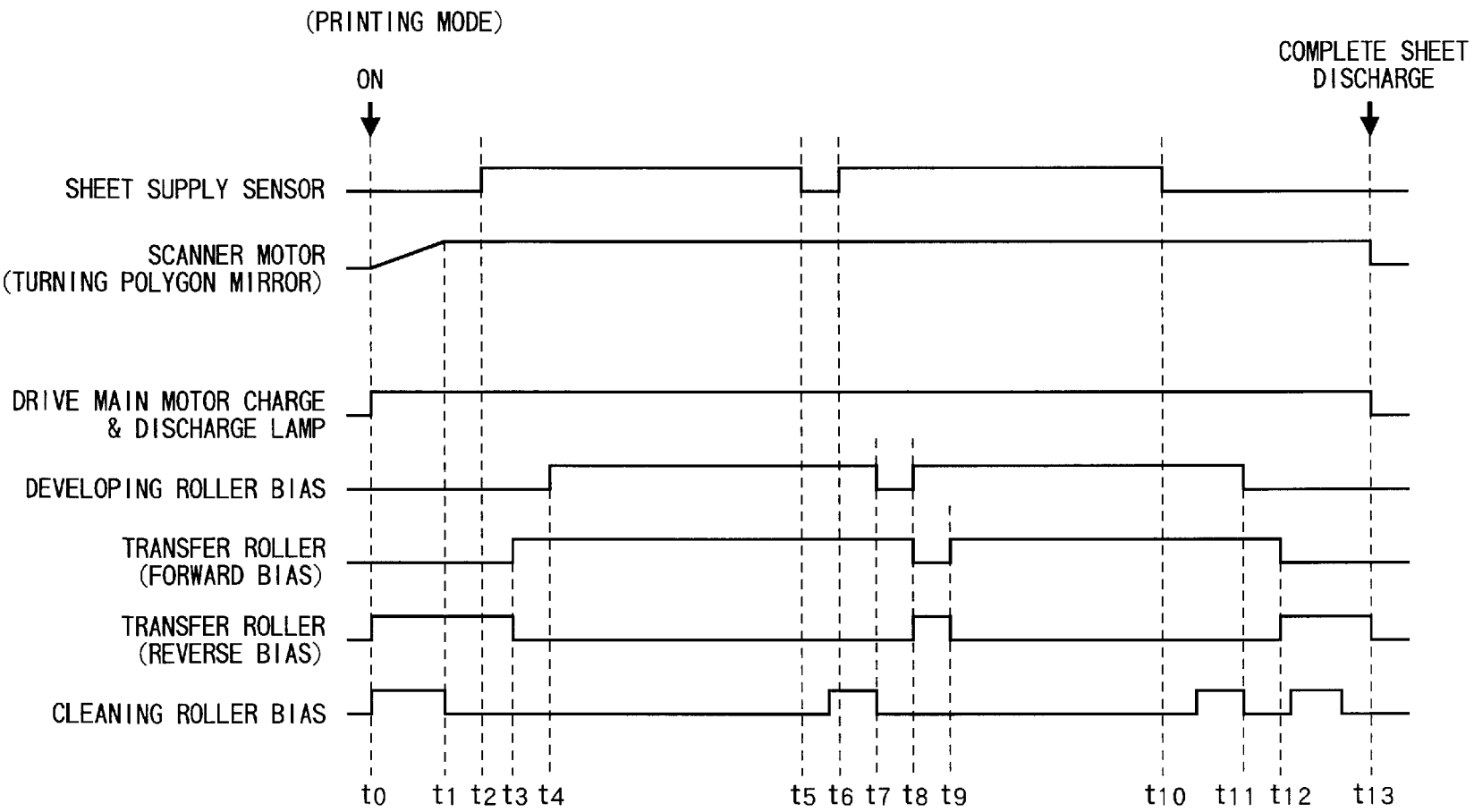
FIG. 6 is a timing chart in a printing mode.

Driving timing of each component in the printing mode will be described with reference to a timing chart shown in FIG. 6 in which printing operation is performed for printing image on two sheets P in accordance with printing signals transmitted form the external data transmission device PC.

At a time t0, the scanner motor 86 starts rotation, and the main motor 84, the charger 26 and the discharge lamp 30*a* are also driven. Further, the transfer roller 25 is applied with a reverse bias voltage whose potential is equal to that applied to the photosensitive drum 23 in order of perform cleaning to the transfer roller 25 by returning the toner affixed onto the transfer roller 25 to the photosensitive drum 23. For example, if the photosensitive drum 23 is charged with negative polarity, the transfer roller 25 is charged with a negative polarity for transferring the negatively charged toner on the transfer roller 25 to the latent imaging area having positive polarity of the photosensitive drum 23. Further, a bias voltage is also applied to the cleaning roller 30 from the timing t0 to t1 in order to transfer the toner retained on the cleaning roller 30 onto the photosensitive drum 23. The toners returned from the transfer roller 25 and the cleaning roller 30 to the photosensitive drum 23 is collected into the process unit 3 by the developing roller 27 so that the collected toner can be re-used for a subsequent developing operation.

After the sheet is detected at the timing t2 by the sheet supply sensor 51, the reverse bias voltage applied to the transfer roller 25 is shut off at a timing t3. Instead, a forward bias is applied as the transfer bias to the transfer roller 25. That is, in order to promote toner adhesion onto the sheet P, the transfer roller 25 is imparted with a polarity opposite the photosensitive drum 23. Because of the opposite polarity, the toner which has been adhered on the photosensitive drum 23 in an image-wise fashion is electrostatically moved onto the sheet P nipped between the photosensitive drum 23 and the transfer roller 25.

Then, the developing roller 27 is applied with a bias voltage at a time t4 in order to adhere toner onto the photosensitive drum 23 for forming a visible toner image corresponding to the electrostatic latent image.

Thereafter, in accordance with the non detection of the sheet by the sheet supply sensor 51 at a time t5, the bias voltage applied to the developing roller 27 is shut off at a time t7, and then, in the transfer roller 25 the forward bias is rendered OFF and the reverse bias is rendered ON at a time t8. Again, in response to the second sheet detection by the sheet supply sensor 51 at a time t6, the bias voltage applied to the developing roller 27 is rendered ON at the time t8, and in the transfer roller 25 the forward bias is rendered ON and the reverse bias is rendered OFF at a time t9.

If detection of the second sheet is terminated at a time t10, then, the bias voltage applied to the developing roller 27 is rendered OFF at a time t11, and the forward bias is rendered OFF and the reverse bias is rendered ON in the transfer roller 25 at a time t12. If the sheet discharge has been completed as a result of the detection by the sheet discharge sensor (not shown), the scanner motor 86, the main motor 84, the charger 26 and the discharge lamp 30*a* are turned OFF, and the reverse bias applied to the transfer roller 25 is rendered OFF at a time t13.

In the step S1000, if the judgment determines a mode other than the printing mode and the lamination mode, such as a mode for outputting managing items of the printer, the managing items of the printer are printed based on the setting data in accordance with the image forming process described above (S3000).

If the operator sets the lamination mode, a lamination process (S4000) will be executed. For starting the lamination mode, the printed sheet card 106 is sandwiched between the two lamination members 102, 104 whose each one side 100 are joined together as shown in FIGS. 8(*a*) and 8(*b*). The lamination members 102, 104 retaining therein the printed card 106 are inserted into the manual insertion port 5*b* with the joined side 100 being the leading edge. Then, the lamination mode is selected by manipulating the panel switch 1*e*.

Figure 5:
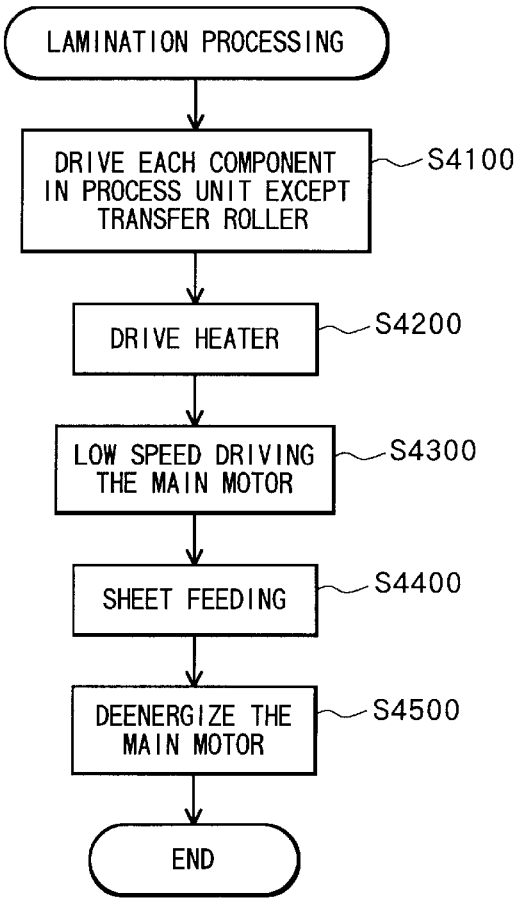
FIG. 5 is a flowchart showing a lamination processing executed in the control unit.

The lamination process is shown by a flowchart of FIG. 5. First each component in the process unit 3 other than the transfer roller 25 is driven (S4100). That is, a high electric field is generated in the photosensitive drum 23, the charger 26, the developing roller 27 and the cleaning roller 30 by the high voltage board 92 similar to the printing mode, and the discharge lamp 30*a* is lighted. On the other hand, the high electric field which is reverse biased to the photosensitive drum 23 is not imparted to the transfer roller 25 contrary to the printing mode. That is, reverse bias is applied to the transfer roller 25 from time t20 to t23 (FIG. 7) similar to the duration of the printing mode from the time t0 to t3, whereas forward bias is not applied to the transfer roller 25 during the lamination mode.

Then, the heater 15*a* is turned ON so that the temperature of the heater 15*a* is set to a lamination temperature which is higher than the printing temperature in an attempt to impart greater amount of heat to the lamination members for performing the sufficient melt-bonding (S4200). Then, the main motor 84 is rotated at a rotation speed lower than that in the printing mode. For example, the rotation speed in the lamination mode is 1/10 of that in the printing mode (S4300).

Then, the lamination sheet members 102, 104 retaining therein the printed sheet card 106 are fed from the manual insertion port 5*b* to the upper and lower resist rollers 13, 14 by the rotating sheet supply roller 11 and the separation pad 12. Thus, the lamination sheet members 102, 104 are on the sheet feed passage for feeding toward the process unit 3 (S4400). In the process unit 3, an opposite polarity with respect to the photosensitive drum 23 is not generated in the transfer roller 25, because the forward bias voltage is not applied to the transfer roller 25 during the lamination mode.

Figure 7:
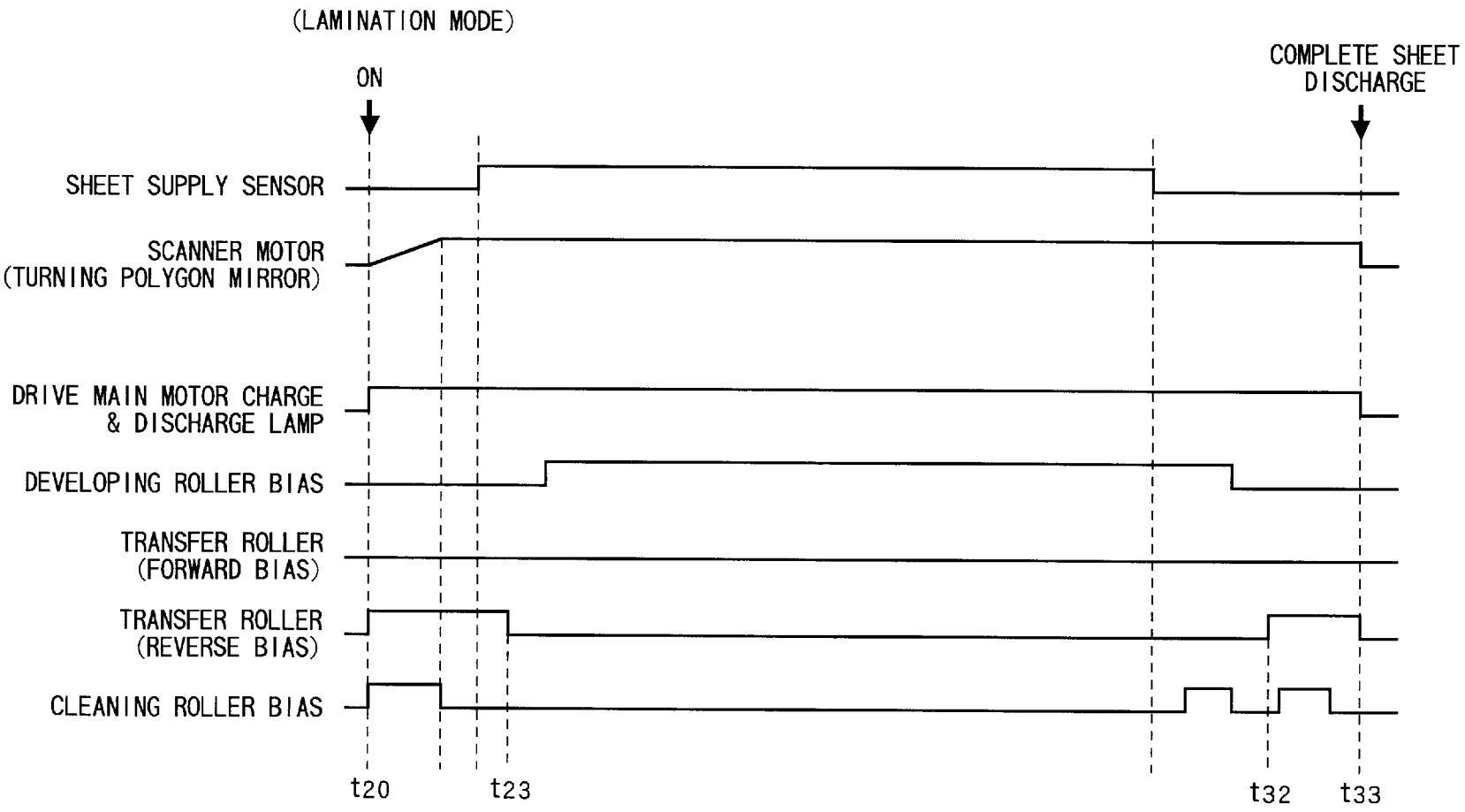
FIG. 7 is a timing chart in a lamination mode.

During the laminating operation, contamination of the lamination sheet members 102, 104 with the residual toner can be avoided by a process shown in the timing chart of FIG. 7, even though this process is not shown in the flowchart of FIG. 5. That is, in the process unit 3, the transfer roller 25 is not imparted with forward bias or reverse bias. Therefore, if the lamination sheet members 102, 104 exist at a position between the photosensitive drum 23 and the transfer roller 25 and even if residual toner exists at the surface of the photosensitive drum 23, the toner is not transferred therefrom nor absorbed onto the lamination sheet members 102, 104. Accordingly, the surface of the lamination sheet members 102, 104 are not contaminated with the toner, even though the lamination sheet members are fed past the sheet passage identical with the passage in case of the printing mode. In other words, the toner image transferring function is nullified in the lamination mode.

Then, the lamination sheet members 102, 104 are heated and pressed by the heat roller 15 and the pressure roller 16. As described above, since the lamination sheet members 102, 104 are fed at a speed lower than that of the printing mode, sufficient heat can be imparted on the lamination sheet members 102, 104 for fuse-bonding the same.

Figure 9:
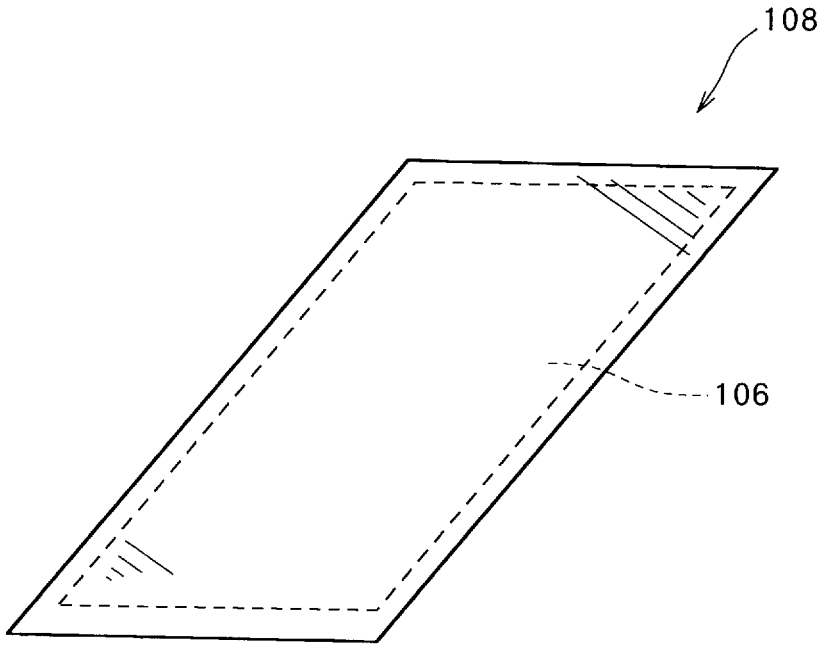
FIG. 9 is a perspective view showing a lamination product.

After the lamination sheet members 102, 104 are moved past the fixing unit 4, these members are cooled by ambient air. When the lamination sheet members 102, 104 are discharged onto the discharge tray 8 after moving past the discharge roller 17 and the pinch roller 18, side edge portions of the lamination sheet members 102, 104 are solidified and bonded together. Thus, the printed sheet card 106 is hermetically sealed by the lamination sheet member 102, 104 to provide a lamination product 108 as shown in FIG. 9. If the discharge of the lamination sheet 108 is detected by the discharge sensor (not shown), the main motor 84 is deenergized (S4500), and the lamination routine is ended.

As is apparent from the timing chart shown in FIG. 7, the reverse bias is applied to the transfer roller 25 at the duration form t20 to t32 and t32 to t33. However, forward bias is not applied to the transfer roller 25. In other words, when the lamination sheet members 102, 104 are located at a position between the photosensitive drum 23 and the transfer roller 25, neither the reverse bias nor the forward bias is applied to the transfer roller 25. Thus, the residual toner is transferred from neither the photosensitive drum 23 nor the transfer roller 25 to the lamination sheet members 102, 104. Consequently, the lamination product has a clean surface without any contamination with the toner.

While the invention has been described in detail and with reference to the specific embodiments thereof, it would be apparent to those skilled in the art that various changes and modifications may be made therein without departing from the spirit and scope of the invention.

For example, in the above described embodiment, the application of the forward bias to the transfer roller 25 is prohibited in the lamination mode. However, the application of the bias voltage can also be prohibited with respect to the developing roller 27 and the cleaning roller 30.

Further, in the depicted embodiment, rotation speed of the main motor 84 in the lamination mode is lower than that in the printing mode, and at the same time, the temperature of the heater 15*a* in the lamination mode is higher than that in the printing mode in order to impart sufficient heat on the lamination sheet members. However, either the speed reduction or temperature rise is available as far as the lamination sheet members can receive sufficient heat.

Further, the manual insertion port 5*b* can be dispensed with. In this case, the lamination sheet members 102, 104 are inserted into the sheet feed unit 5. Further, the above described arrangement is also applied to a facsimile machine and a copying machine.

What is claimed is:

1. An image forming device for forming an image on an image recording medium and for heat sealing lamination sheet members, the device comprising:

a developing portion including a photosensitive member, a bias portion and a transfer portion, an electrostatic latent image being formed on the photosensitive member in accordance with an imaging information for forming a toner image corresponding to the electrostatic latent image, the transfer portion being in confronting relation with the photosensitive member for transferring the toner image onto the image recording medium, and the bias portion applying a bias voltage to the photsensitive member;

a fixing portion for heating and fixing the toner image to the image recording medium;

a passage passing between the photosensitive member and the transfer portion and passing through the fixing portion, one of the image recording medium and the lamination sheet members being selectively passed through the passage;

a mode setting unit for setting one of a printing mode and a lamination mode, the fixing portion heat-sealing the lamination sheet members when the lamination sheet members pass therethrough in the lamination mode; and a control unit connected to the mode setting unit and activating the transfer portion and the bias portion in response to a selection of the printing mode and maintaining the bias voltage and deactivating the transfer portion in response to a selection of the lamination mode.

2. The image forming device as claimed in claim 1, further comprising a transfer bias application portion connected to the transfer portion for applying a transfer bias to the transfer portion so that polarities of the photosensitive member and the transfer portion are opposite to each other for electrostatically moving the toner image on the photosensitive member onto the image recording medium.

3. The image forming device as claimed in claim 2, wherein the control unit is connected to the transfer bias application portion so that the transfer bias is applied to the transfer portion in response to the selection of the printing mode and the application of the transfer bias to the transfer portion is prohibited in response to the selection of the lamination mode.

4. The image forming device as claimed in claim 1, wherein the image recording medium comprises cut sheets, and the device further comprising:

an automatic sheet feeder for supplying each one of the cut sheets to the passage and at a position upstream of the developing portion in case of the printing mode; and a manual insertion portion through which the lamination sheet members are inserted into the passage and at the position upstream of the developing portion in case of the lamination mode.

5. The image forming device as claimed in claim 1, wherein the fixing unit provides a first feeding speed for feeding the image recording medium passing therethrough in case of the printing mode and a second feeding speed for feeding the lamination sheet members passing therethrough in case of the lamination mode, the second feeding speed being lower than the first feeding speed.

6. The image forming device as claimed in claim 5, wherein the fixing device comprises a heat roller and a pressure roller, one of the image recording medium and the lamination sheet members being nipped between the heat roller and the pressure roller, the control unit controlling a rotation speed of the heat roller so that the heat roller provides the first rotation speed in response to the printing mode and provides the second rotation speed in response to the lamination mode.

7. The image forming device as claimed in claim 6, wherein the heat roller provides a heating element connected to the control unit so that the heating element provides a first heating temperature in the printing mode and a second heating temperature higher than the first heating temperature in the lamination mode.

8. The image forming device as claimed in claim 1, wherein the fixing device comprises a heat roller having a heating element and a pressure roller, one of the image recording medium and the lamination sheet members being nipped between the heat roller and the pressure roller, the heating element being connected to the control unit so that the heating element provides a first heating temperature in the printing mode and a second heating temperature higher than the first heating temperature in the lamination mode.

9. The image forming device as claimed in claim 1, wherein the photosensitive member comprises a photosensitive drum, and wherein the transfer portion comprises a transfer roller, the passage extending between the photosensitive drum and the transfer roller.

10. An image forming device for forming an image on an image recording medium and for heat sealing lamination sheet members, the device comprising:

a developing portion including a photosensitive drum, a drum bias portion and a transfer roller, an electrostatic image being formed on the photosensitive drum in accordance with an imaging information for forming a toner image corresponding to the electrostatic latent image, the transfer roller being in confronting relation with the photosensitive drum for transferring the toner image onto the image recording medium, and the drum bias portion applying a drum bias voltage to the photosensitive drum;

a fixing portion for heating and fixing the toner image to the image recording medium;

a passage passing between the photosensitive drum and the transfer roller and passing through the fixing portion, one of the image recording medium and the lamination sheet members being selectively passed through the passage;

a mode setting unit for setting one of a printing mode and a lamination mode, the fixing portion heat-sealing the lamination sheet members when the lamination sheet members pass therethrough in the lamination mode;

a voltage board connected to the transfer roller and the photosensitive drum for applying a transfer bias voltage to the transfer roller and a drum bias voltage to the photosensitive drum; and a control unit connected between the mode setting unit and the voltage board for applying the transfer bias voltage to the transfer roller and for applying the drum bias voltage to the photosensitive drum in response to a selection of the printing mode and for applying the drum bias voltage to the photosensitive drum and preventing application of the transfer bias voltage to the transfer roller in response to a selection of the lamination mode.

11. The image forming device as claimed in claim 10, wherein the developing portion further comprising a developing roller in contact with the photosensitive drum for supplying the toner to the photosensitive drum, and a cleaning roller in contact with the photosensitive drum for removing residual toner on the photosensitive drum, and wherein the voltage board is also connected to the developing roller and the cleaning roller for applying bias voltages, respectively.

12. The image forming device as claimed in claim 10, wherein the image recording medium comprises cut sheets, and the device further comprising:

an automatic sheet feeder for supplying each one of the cut sheets to the passage and at a position upstream of the developing portion in case of the printing mode; and a manual insertion portion through which the lamination sheet members are inserted into the passage and at the position upstream of the developing portion in case of the lamination mode.

13. The image forming device as claimed in claim 10, wherein the fixing unit provides a first feeding speed for feeding the image recording medium passing therethrough in case of the printing mode and a second feeding speed for feeding the lamination sheet members passing therethrough in case of the lamination mode, the second feeding speed being lower than the first feeding speed.

14. The image forming device as claimed in claim 13, wherein the fixing device comprises a heat roller and a pressure roller, one of the image recording medium and the lamination sheet members being nipped between the heat roller and the pressure roller, the control unit controlling a rotation speed of the heat roller so that the heat roller provides the first rotation speed in response to the printing mode and provides the second rotation speed in response to the lamination mode.

15. The image forming device as claimed in claim 14, wherein the heat roller has a heating element connected to the control unit so that the heating element provides a first heating temperature in the printing mode and a second heating temperature higher than the first heating temperature in the lamination mode.

16. The image forming device as claimed in claim 10, wherein the fixing device comprises a heat roller having a heating element and a pressure roller, one of the image recording medium and the lamination sheet members being nipped between the heat roller and the pressure roller, the heating element being connected to the control unit so that the heating element provides a first heating temperature in the printing mode and a second heating temperature higher than the first heating temperature in the lamination mode.

* * * * *